US009318838B2

(12) United States Patent
Karadimas et al.

(10) Patent No.: US 9,318,838 B2
(45) Date of Patent: Apr. 19, 2016

(54) TERMINAL AND ELECTRICAL CONNECTOR WITH SAME

(75) Inventors: Margaret Karadimas, Lisle, IL (US); Arvind Patel, Naperville, IL (US)

(73) Assignee: Molex, LLC, Lisle, IL (US)

( * ) Notice: Subject to any disclaimer, the term of this patent is extended or adjusted under 35 U.S.C. 154(b) by 115 days.

(21) Appl. No.: 14/233,449

(22) PCT Filed: Jul. 18, 2012

(86) PCT No.: PCT/US2012/047119

§ 371 (c)(1), (2), (4) Date: May 5, 2014

(87) PCT Pub. No.: WO2013/012887

PCT Pub. Date: Jan. 24, 2013

(65) Prior Publication Data

US 2014/0242824 A1 Aug. 28, 2014

Related U.S. Application Data

(60) Provisional application No. 61/509,367, filed on Jul. 19, 2011.

(51) Int. Cl.
*H01R 13/53* (2006.01)
*H01R 13/11* (2006.01)

(52) U.S. Cl.
CPC ..... *H01R 13/53* (2013.01); *H01R 13/113* (2013.01)

(58) Field of Classification Search
CPC ..... H01R 13/53; H01R 13/11; H01R 24/00
USPC ..... 439/181, 842, 843, 851, 852
See application file for complete search history.

(56) References Cited

U.S. PATENT DOCUMENTS 4,681,393 A * 7/1987 Fukishima ..... H01R 13/057 439/851
4,887,980 A * 12/1989 Siegrist ..... H01R 13/113 439/842

(Continued)

FOREIGN PATENT DOCUMENTS

JP 03-062466 U 6/1991
JP 2001-230012 A 8/2001

(Continued)

OTHER PUBLICATIONS

International Search Report for PCT/US2012/047119.

*Primary Examiner* — Abdullah Riyami
*Assistant Examiner* — Nader J Alhawamdeh
(74) *Attorney, Agent, or Firm* — James A. O'Malley

(57) ABSTRACT

A connector is provided that includes a female terminal with sacrificial portion. The terminal is configured to minimize arcing between a mating male terminal and an intended contact portion of the female terminal. The female terminal is configured such that arcs between the male terminal and the female terminal occur such that the sacrificial portion of the female terminal experiences any arcing while the intended contact portion remains suitable for reliably engaging the male terminal.

20 Claims, 15 Drawing Sheets

(56) References Cited

U.S. PATENT DOCUMENTS

| | | | | |
|---|---|---|---|---|
| 6,790,101 | B1 | 9/2004 | Data et al. | |
| 6,811,450 | B1 * | 11/2004 | Data | H01R 13/114 439/181 |
| 6,918,798 | B2 * | 7/2005 | Patel | H01R 13/114 439/851 |
| 2003/0060068 | A1 * | 3/2003 | Kunugi | H01R 11/287 439/181 |
| 2005/0014422 | A1 * | 1/2005 | Patel | H01R 13/114 439/851 |
| 2007/0072490 | A1 * | 3/2007 | Karadimas | H01R 12/58 439/637 |

FOREIGN PATENT DOCUMENTS

| | | | |
|---|---|---|---|
| JP | 2003-178830 | A | 6/2003 |
| JP | 2010-123264 | A | 6/2010 |

* cited by examiner

TERMINAL AND ELECTRICAL CONNECTOR WITH SAME

RELATED APPLICATIONS

This application claims priority to U.S. Provisional Appln. No. 61/509,367, filed Jul. 19, 2011, which is incorporated herein by reference in its entirety.

FIELD OF THE INVENTION

This invention relates generally to the art of electrical connectors, and, more particularly, to a female or socket terminal for an electrical connector.

BACKGROUND OF THE INVENTION

Mating electrical connectors typically employ pairs of inter-engaging pin and socket terminals for interconnecting a plurality of circuits or wires through the mated connectors. The pin and socket terminals are often called male and female terminals.

One type of female terminal includes a generally rectangular socket or receptacle at its mating end for receiving a generally rectangular pin or male terminal therein. The mating end is formed by an elongate body defining top and bottom walls and spaced apart opposing sidewalls, thereby defining a passageway for receiving the male terminal. Such terminals are conventionally stamped and formed from sheet material and the top and bottom walls may have open seams or slits, whereby the opposing sidewalls can flex transversely to the longitudinal axis of the terminal to enlarge the passageway as the male terminal is inserted therein.

Many applications require that connectors equipped with these types of terminals be plugged or mated together while electrical power is present at the terminals. Such connectors are known as hot pluggable connectors. During mating, and primarily unmating of the terminals in these hot pluggable connectors, electrical arcs are created by electrical current passing through the terminals as the terminals are mated or unmated. The terminals may become damaged by such arcing. Furthermore, non-conductive or poorly conducting residues, such as carbon and the like, may build up on the electrical contacts in the terminals due to the arcing. Such residues can interfere with the quality of the electrical contact between the terminals in a subsequent connection.

Some attempts to provide protection against arc discharging in the prior art include providing separate sequential terminals, or providing forward or lateral extensions on the terminals for sequential engagement of the terminals. While effective in reducing the negative effects of arcing, such terminals were larger than necessary due to the extra space required by these forward or lateral extensions. In some cases, these modified terminals were also more complicated to manufacture. Thus certain individuals would appreciate an improved terminal and/or connector system using the same.

SUMMARY OF THE INVENTION

In the exemplary embodiment, a female terminal has a mating end to receive a male pin with spaced apart flat surfaces and a circuit connecting end for connection to a wire, or the like. The elongate body of the female terminal defines a terminal-receiving passageway with two spaced apart sidewalls extending lengthwise along the passageway. One or more primary terminal contacts are disposed inwardly from at least one of the sidewalls into the terminal-receiving passageway to provide the electrical contact between the female and male terminals when the male terminal is fully inserted into the female terminal. One or more arc discharging contacts are formed forwardly of the primary contacts to engage the male pin first to accept the arcing that can occur between electrical connections that are mated while one terminal is coupled to a power source (e.g., hot pluggable).

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, in the several figures in which like reference numerals identify like elements, and in which:

DETAILED DESCRIPTION OF THE INVENTION

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

In certain embodiments the depicted embodiments can provide an improved female electrical terminal that helps control discharging arcs between mating terminals as connectors are hot plugged together. Certain embodiments allow one or more sacrificial electrical contacts in a female terminal configured to engage the male terminal to discharge any arcs before the male terminal engages the primary electrical contacts. This can allow the provision of a female terminal with arc discharge protection for the primary contacts which is compact and inexpensive to manufacture.

Figure 1:
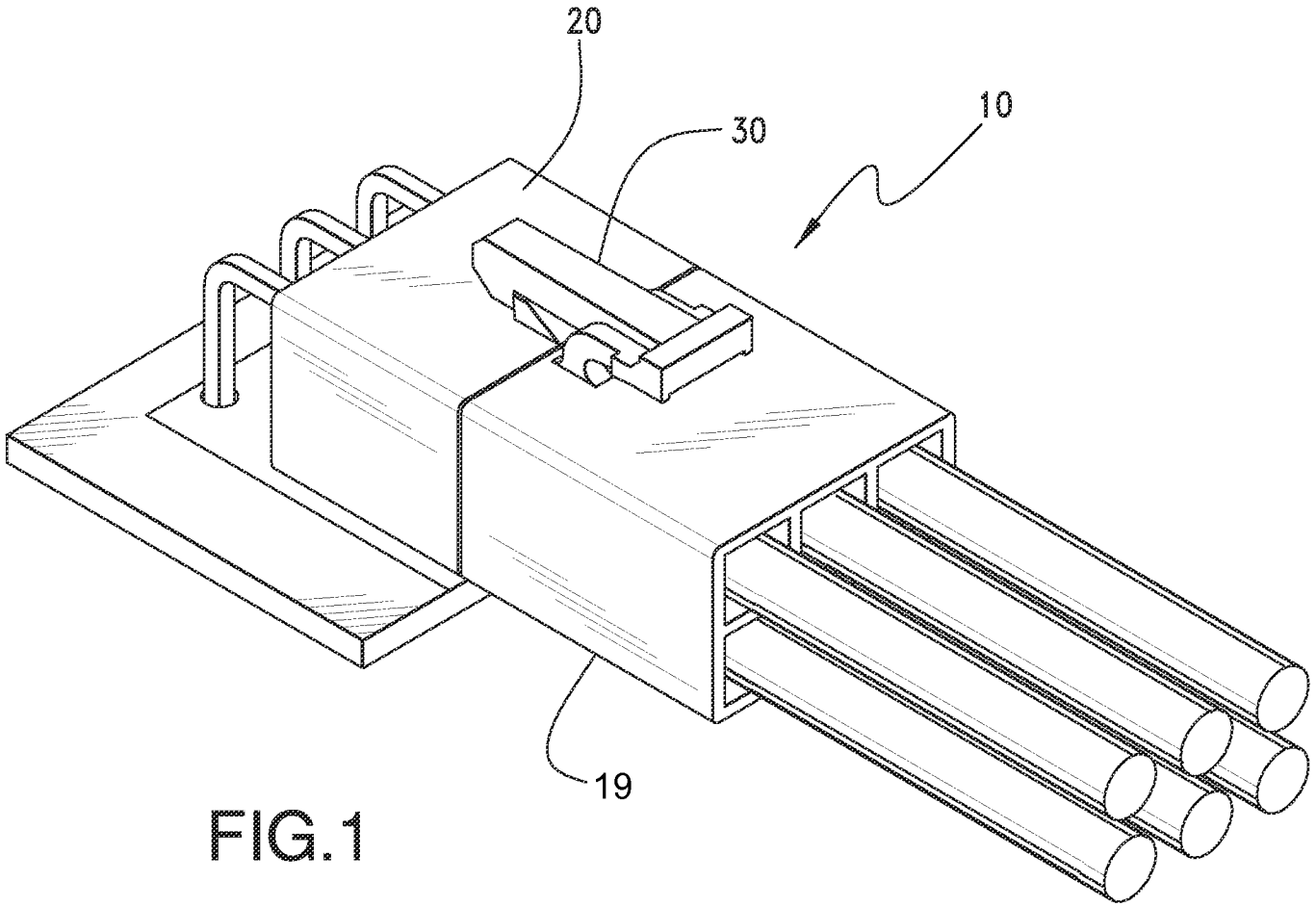
FIG. 1 is a top perspective view of the electrical connector system showing the plug connector and the receptacle connector mated together.
Figure 2:
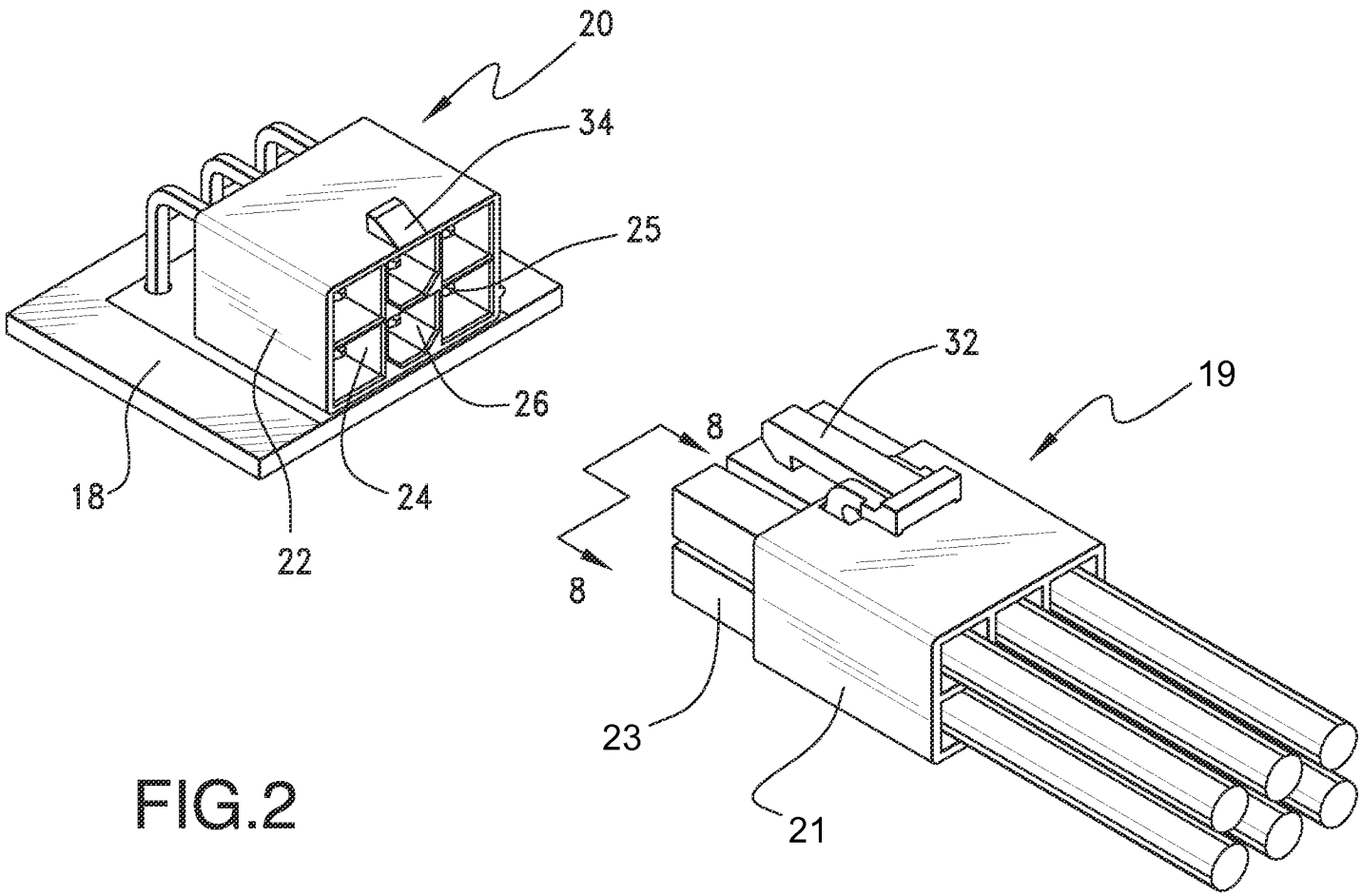
FIG. 2 is a top perspective view of the electrical connector with the plug connector removed from the receptacle connector.
Figure 3:
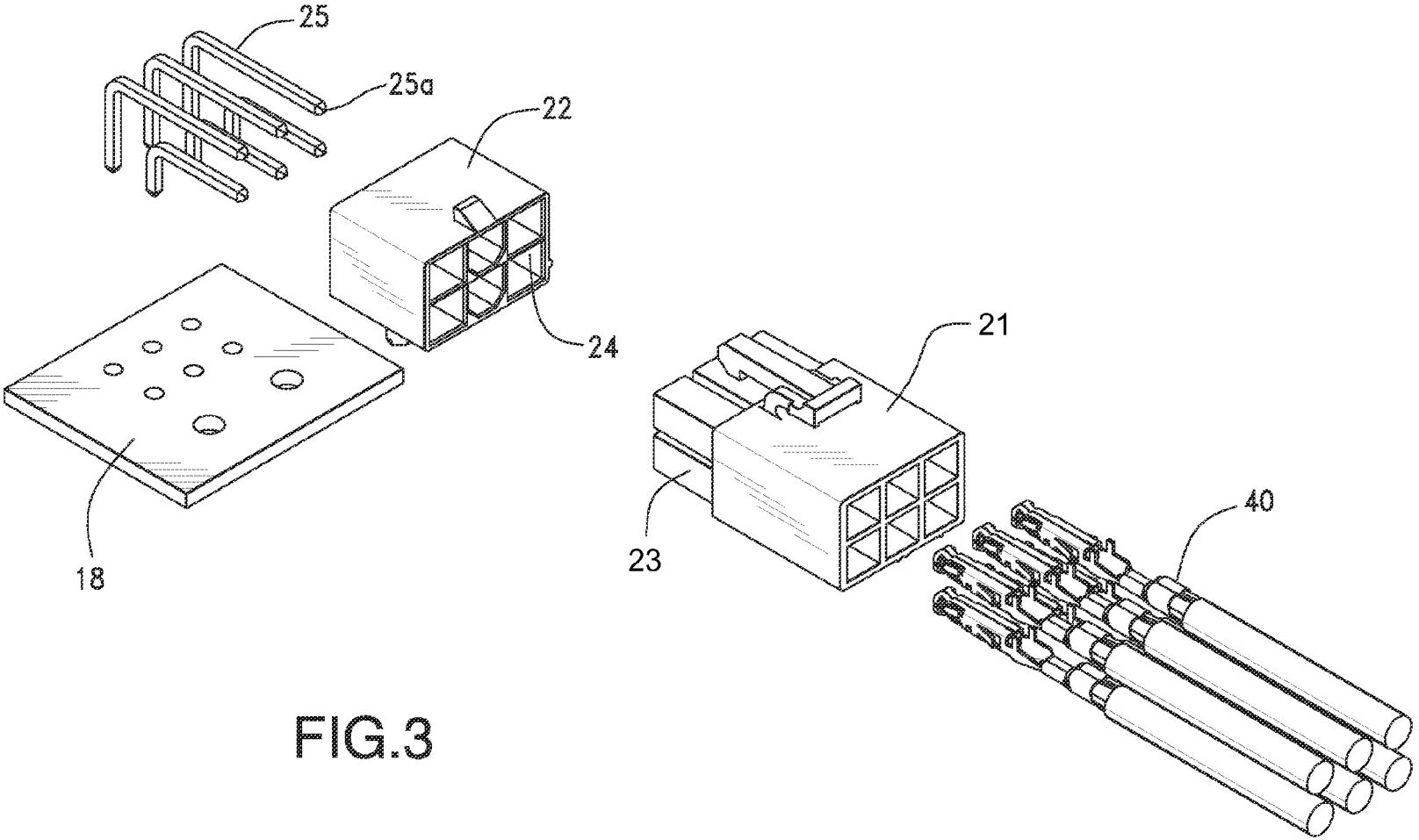
FIG. 3 is an exploded view of the connector system.
Figure 4:
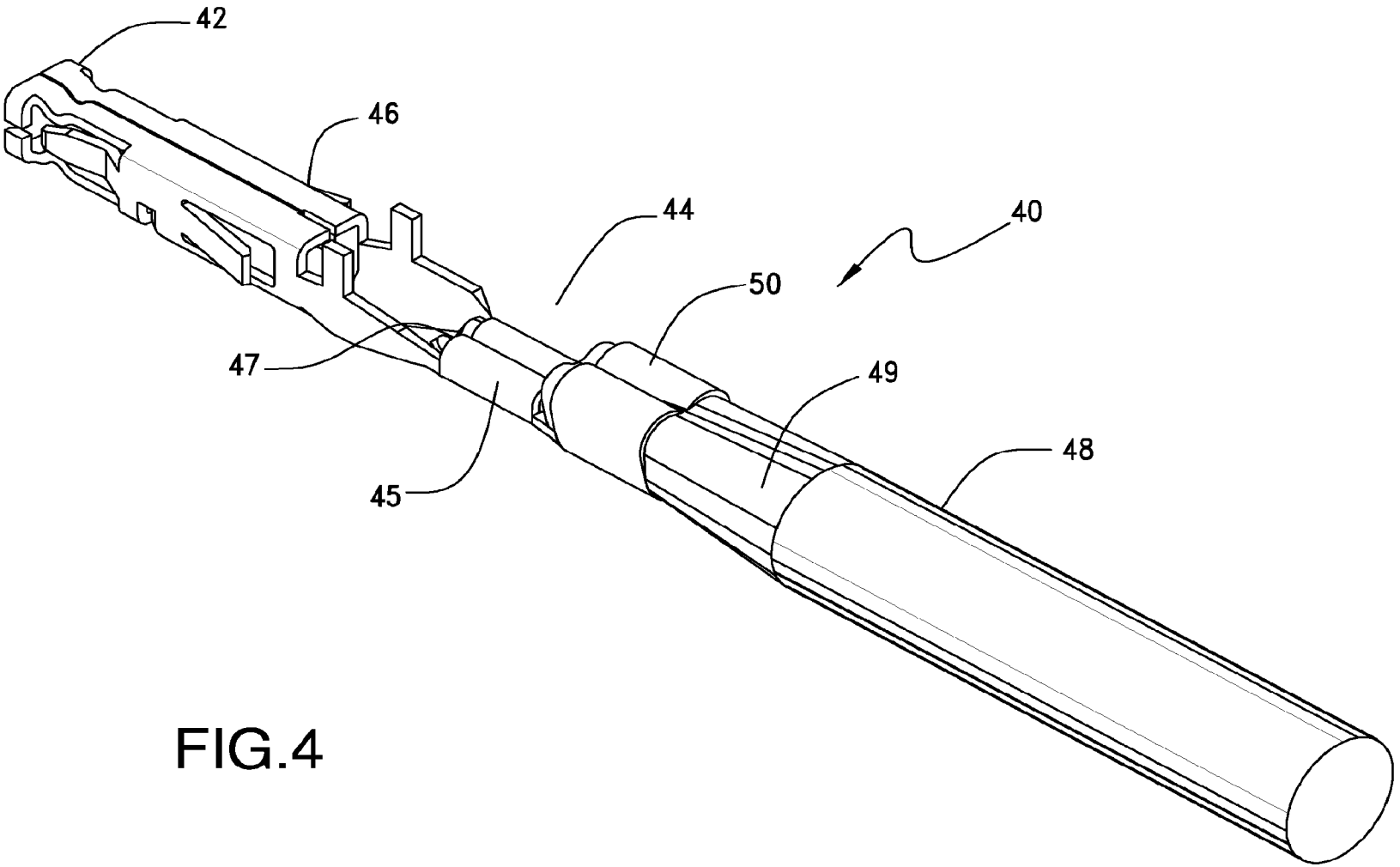
FIG. 4 is a top perspective view of a female terminal lead looking from the termination end of the female terminal.

Referring to the drawings in greater detail and first to FIGS. 1 to 3, the invention is incorporated in a power connector or the like generally designated 10, having a plug 19 and receptacle 20. The receptacle connector 20 is shown as a right angle circuit board connector but may be of any type including a wire harness connector. The receptacle connector 20 includes a plurality of male terminal pins 25, retained in an insulative housing 22 and typically mounted to a printed circuit board designated 18. The plug connector 19 includes corresponding female terminals 40 retained in an insulative housing 21 for mating with the receptacle insulative housing 22. The housings 21, 22 include a selectively engageable locking structure 30 used to retain the plug connector 19 and receptacle connector 20 together. The locking structure 30 has a resilient latching portion 32 typically formed on the plug housing 21 and a lock portion 34 generally formed on the receptacle housing 22.

Each male terminal 25 and female terminal 40 has a portion 24, 23 of their corresponding insulative housing 22, 23 generally surrounding each respective terminal 25, 40. These portions 24, 23 of the housing 22, 21 can provide an insulative enclosure that encloses at least a portion of each terminal 25, 40. These portions 24, 23 of the housing 22, 21 may include a keying feature 26 that allows selective housing configurations to engage only the correct mating connector halves.

The female terminal 40 includes a mating portion or end, generally designated 42, a terminating portion or end, generally designated 44, and an intermediate securing portion or section, generally designated 46.

The female terminal 40 is stamped and formed from sheet metal material, and the terminating end 44 is constructed for crimping onto an electrical wire, generally designated 48. More particularly, the terminating end 44 of the female terminal 40 includes a rear pair of crimp arms 50 for crimping onto the outer insulation 49 of the electrical wire 48, along with a forward pair of crimp arms 45 for crimping onto a stripped or exposed conductor 47 or conductive core of wire 48.

Figure 8:
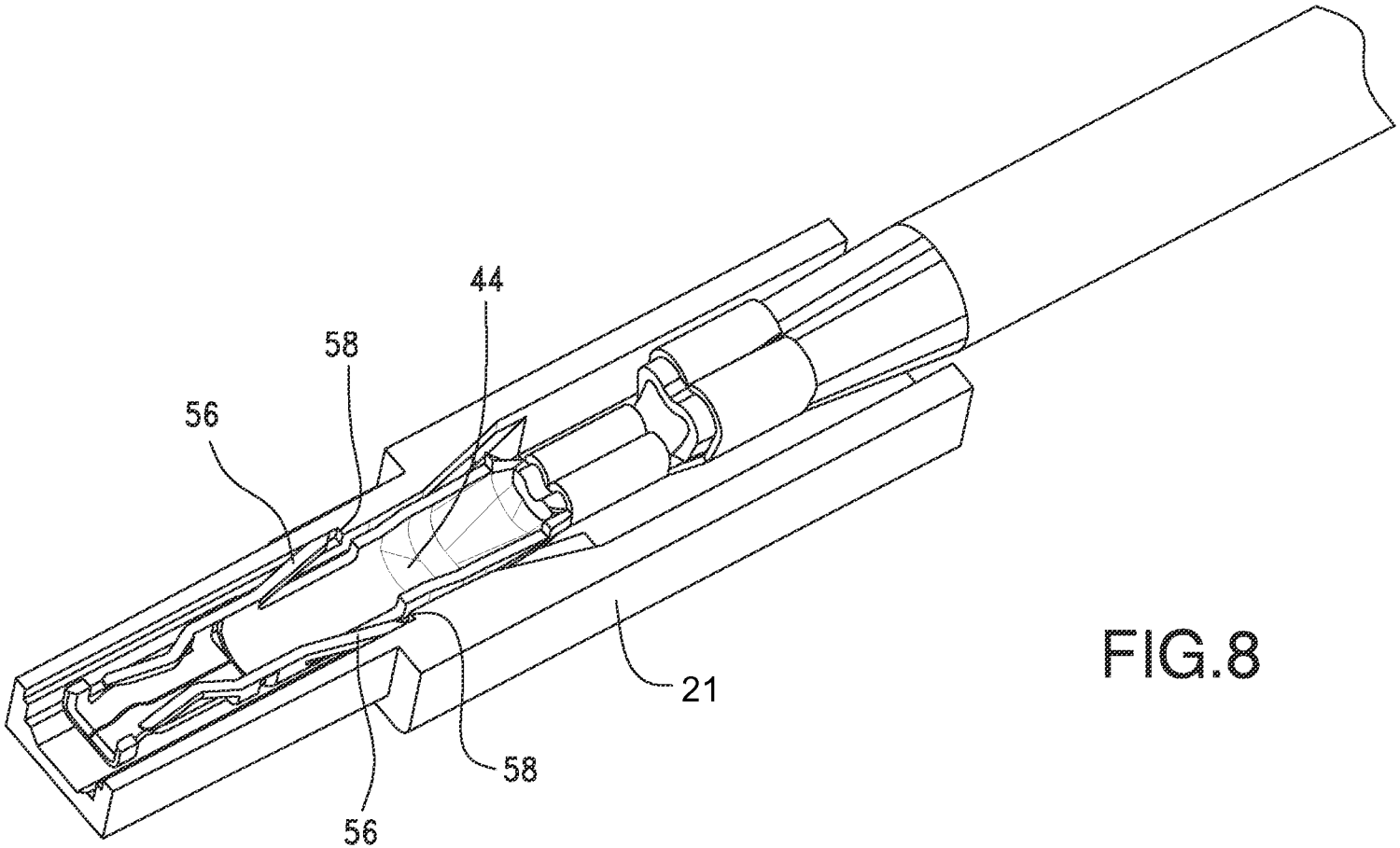
FIG. 8 is a sectional view of the female terminal of FIG. 2 with a portion of the insulative housing cavity surrounding the female terminal.

Intermediate portion 46 of the female terminal 40 includes a pair of stamped and formed locking arms or tabs 56 which project outwardly from opposite sides of the female terminal 40. These locking arms 56 are cantilevered rearwardly and resiliently snap behind locking shoulders 58 in FIG. 8 on the inside of the housing 21, to prevent the female terminal 40 from backing out of housing 21 after the female terminal 40 is inserted therein. The intermediate portion 46 may also include a projection 70 extending downwardly that engage stop shoulders within the connector housing 21 to define the fully inserted position of the female terminal 40 within the housing 21, and to also stabilize the female terminal 40 within the housing 21 against torsional or rotational movement along the longitudinal axis of the female terminal 40.

Figure 5:
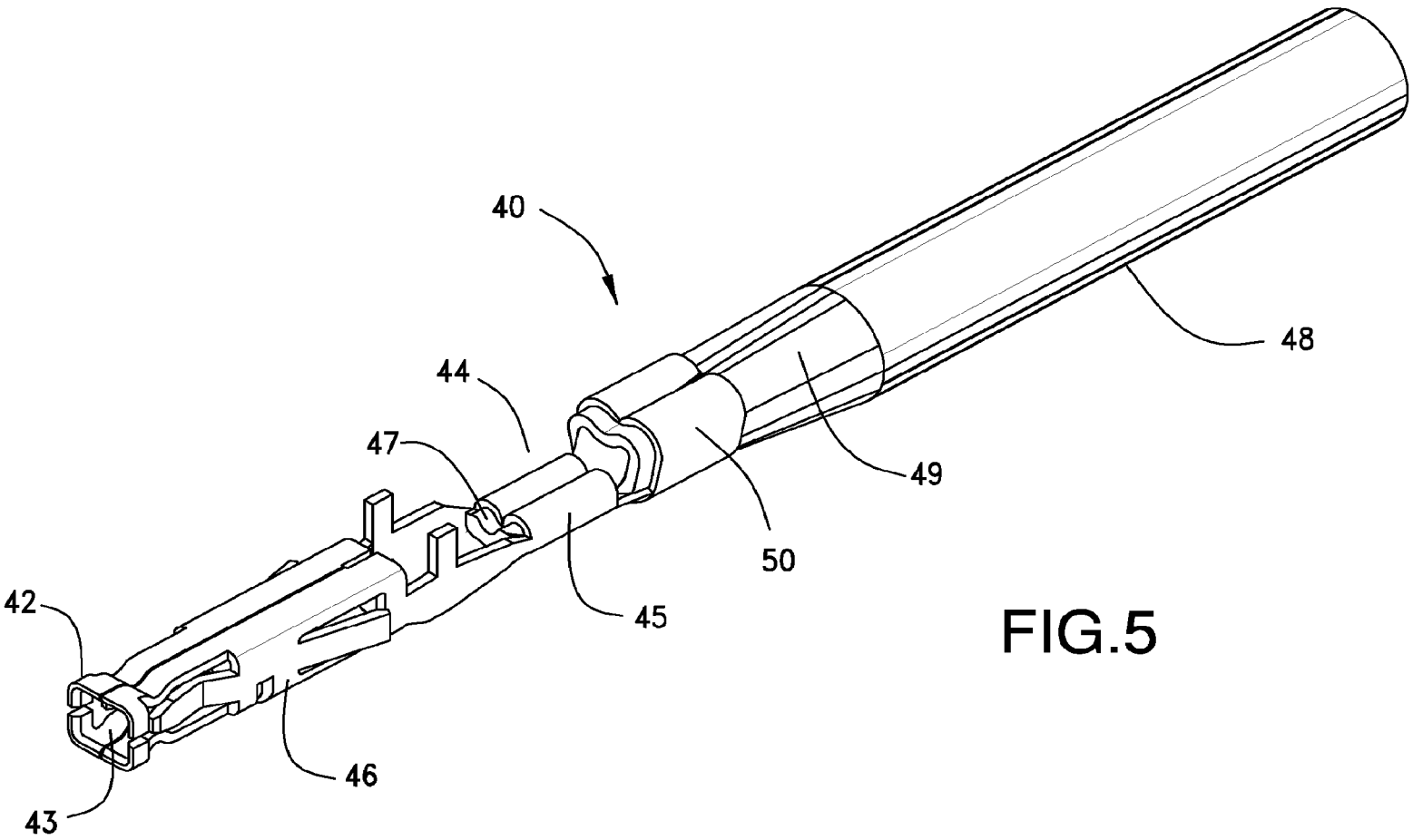
FIG. 5 is a top perspective view of the female terminal lead looking from the mating end of the female terminal.

With reference to FIG. 5, the mating end or portion 42 of the female terminal 40 includes a passageway 43 adapted to receive the male terminal or pin 25, as will be presented in more detail with respect to FIGS. 9-13 below. Male pin 25 preferably has at least two sets of two spaced apart and generally parallel flat sides 35 and 36, such as are provided by a pin with a square or rectangular cross section. Male pin 25 may also have a tapered or wedge-shaped end 25*a* for ease of insertion of the male pin 25 into the passageway 43 of the female terminal 40.

The mating end 42 of the female terminal 40 is formed of a pair of channels 51 and 52 that are of generally U-shaped cross section, and that are separated by open seams or slits 53 and 54 such that the ends of the legs of the U-shaped channels 51 and 52 are spaced adjacently to, but apart from each other. Channels 51 and 52 thereby define a generally rectangular or square shaped passageway 43 therebetween for receiving the male terminal 25 therein.

The bottoms of the U-shaped channels 51 and 52 are generally flat to define a first pair of opposing sidewalls 57 and 59 in the passageway 43, as can best be seen in FIGS. 6-9. Each of U-shaped channels 51 and 52 has opposing channel sidewalls 80, 81 and 82, 83 respectively. Each opposing sidewall 57 59 further includes a second seam or slit 67 and 68 defining two deflection portions 90, 92 and 94, 96 near the open end of the passageway 43 at the mating portion 42 of female terminal 40.

Figure 9:
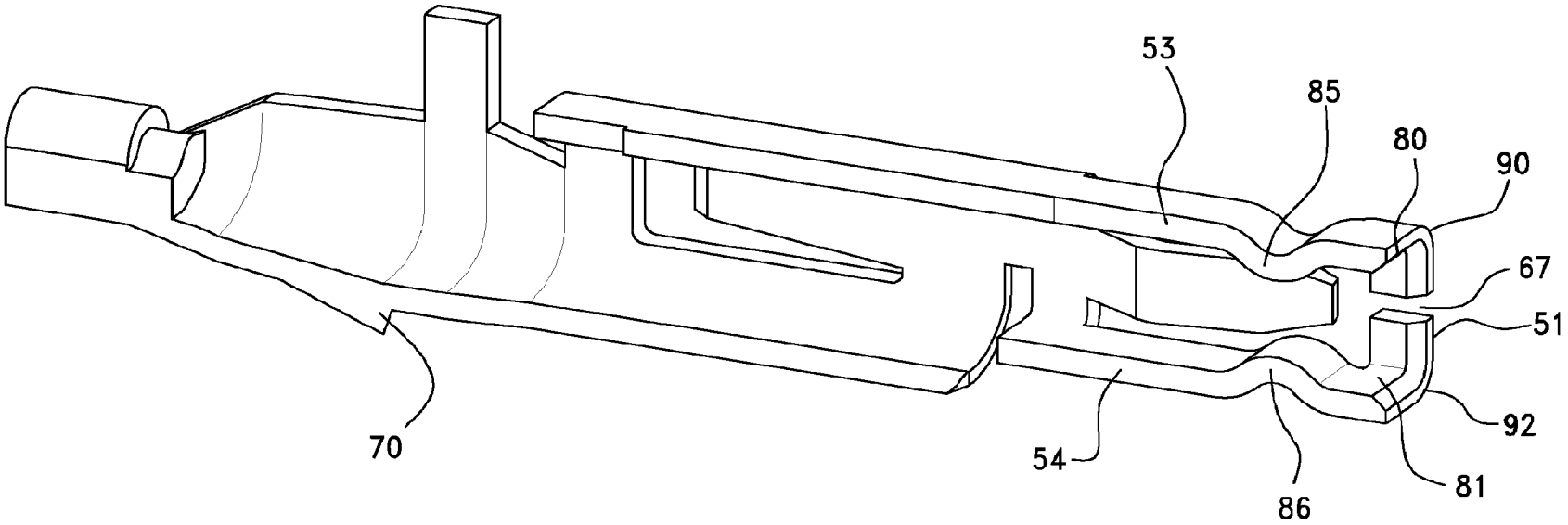
FIG. 9 is a sectional view of the female terminal of FIG. 7*a* showing the arc discharging contacts.

In accordance with one aspect of the present invention, at least one arc discharging contact 85 or 86 is disposed in channel sidewall 80 or 81, respectively, near the open end of the passageway 43. Preferably, arc discharging contacts 85 and 86 are provided in both of the channel sidewalls 80 81 and 82, 83 of each U-shaped channel 51 and 52. As best seen in FIG. 9, one of the arc discharging contacts 85 may be integrally formed into the channel sidewall 80 of channel 51 during the metal stamping and forming processes used to create the female terminal 40.

In the form illustrated in FIG. 9, arc discharging contact 85 has a circular cross-section of metal that is curved inwardly into the passageway 43 defined between channels 51 and 52. This generally curved or circular shape provides the arc discharging contacts 85 and 86 with resiliency to flex against the sides of the male terminal 25 when the male terminal 25 is received in the female terminal 40.

As used herein, the expressions "sacrificial contacts" and "arc discharging contacts" are used interchangeably and are intended to mean the same thing, namely a contact that discharges an arc between two interconnecting terminals. The electrically conductive quality of such contacts is "sacrificed" since arcs leave deposits of non-conductive or poorly conducting residues on the contacts. Nevertheless, these sacrificial contacts do conduct current and will act as additional contact points if the effects of the arc creating non-conductive residue are not extreme.

Enlarged primary contacts 60 and 62 are provided in the mating end 42 of the female terminal 40 to engage and to provide the primary electrical contact between the mating pin 25 and the female terminal 40. These enlarged contacts 60 and 62 are formed in the respective first pair of opposing sidewalls 57 and 59 in the bottoms of the U-shaped channels 51 and 52 by metal forming and stamping techniques that are known in the art.

Figure 10:
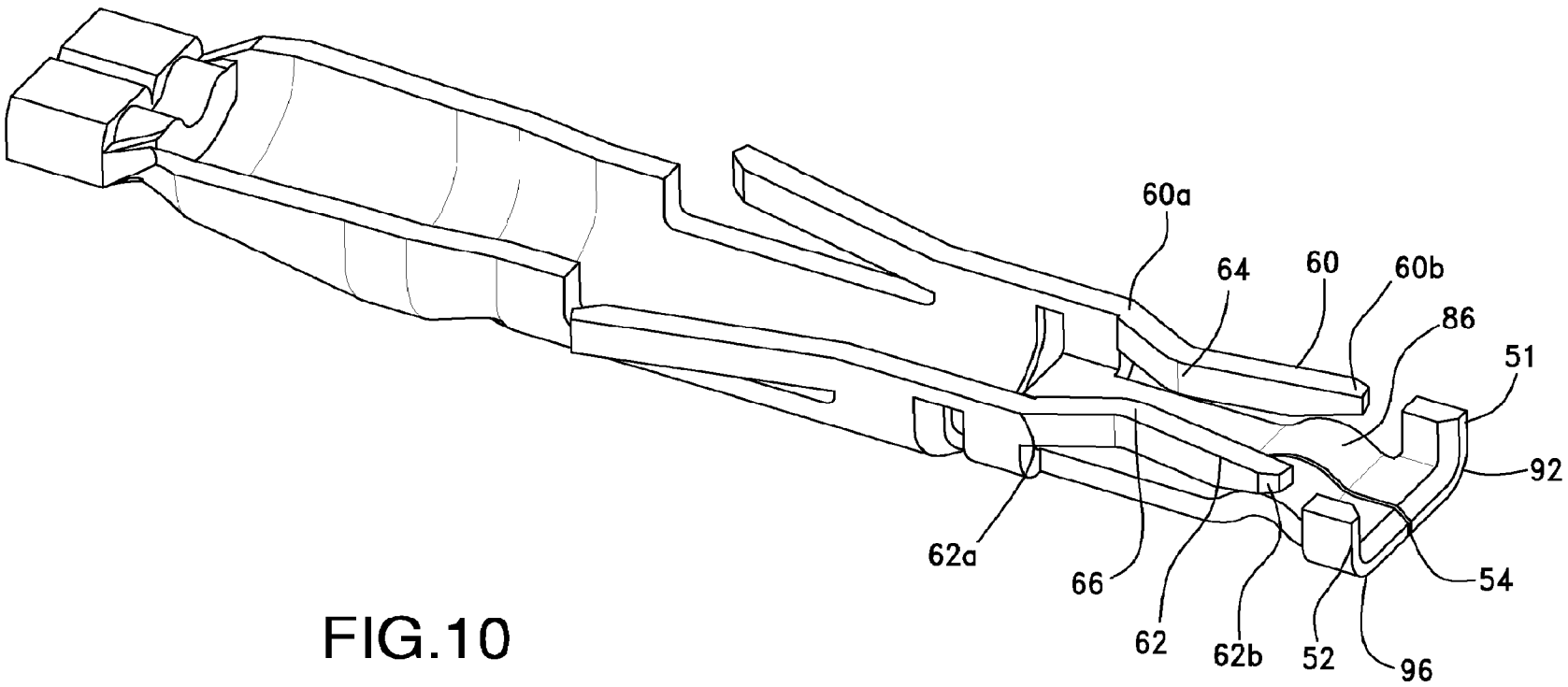
FIG. 10 is a sectional view of the female terminal of FIG. 7*a* showing the primary contacts.

As shown in FIG. 10, the primary contacts 60 and 62 are preferably elongated and formed in the longitudinal direction of the female terminal 40. Each primary contact 60 and 62 includes a cantilever beam having a base portion 60*a*, and 62*a* depending from the bottom sidewall 57 and 59 of each respective U-shaped channel 51 and 52. Each primary contact 60 and 62 has a contact area 64 and 66 respectively provided on the cantilever beam of the primary contacts 60 and 62 of the female terminal 40. The beam portion extends toward the mating end 42 of the female terminal 40 and projects into the passageway 43 to provide an area of contact with the male pin 25.

Figure 6:
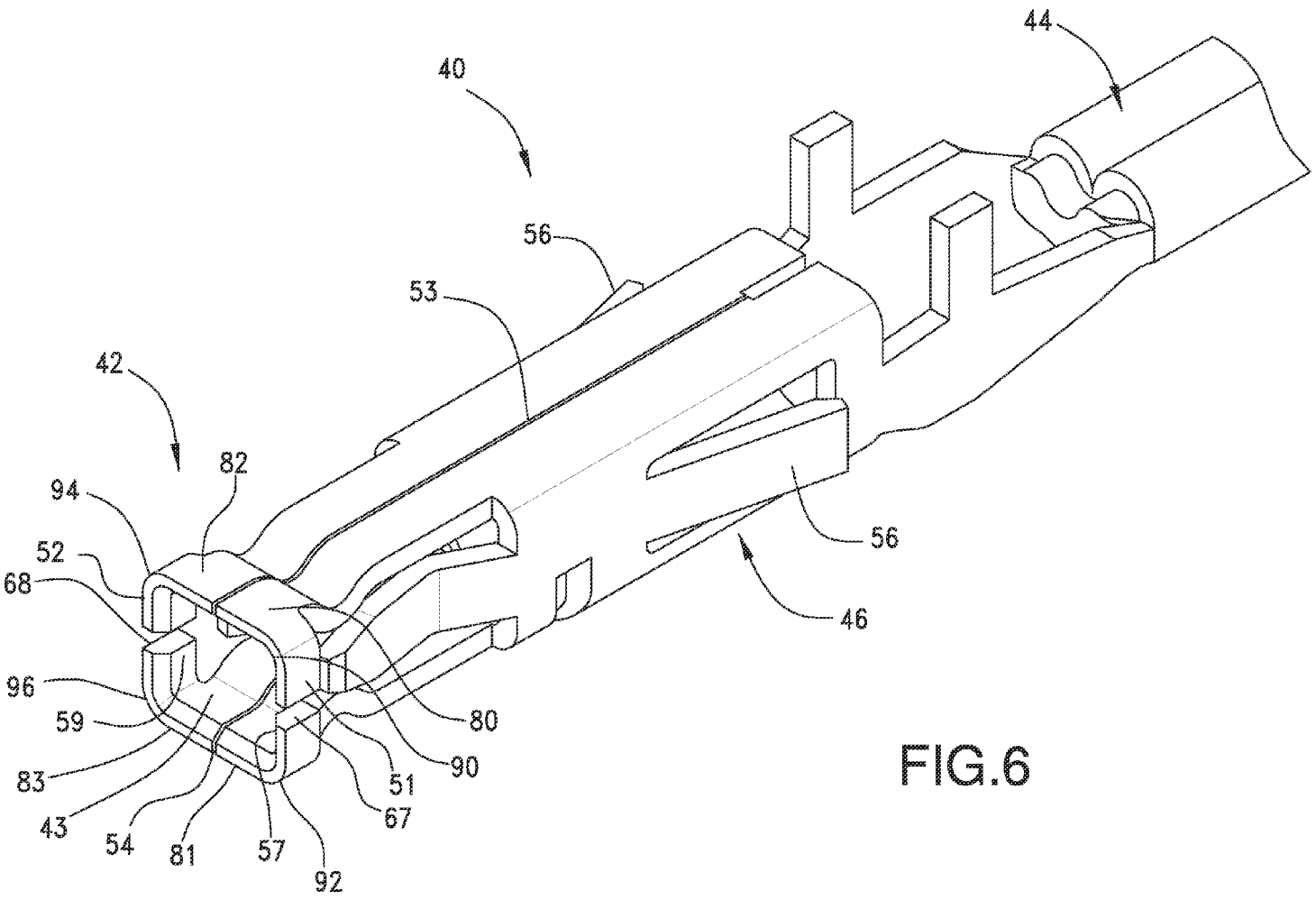
FIG. 6 is an enlarged top perspective of the female terminal shown in FIG. 5.
Figure 7A:
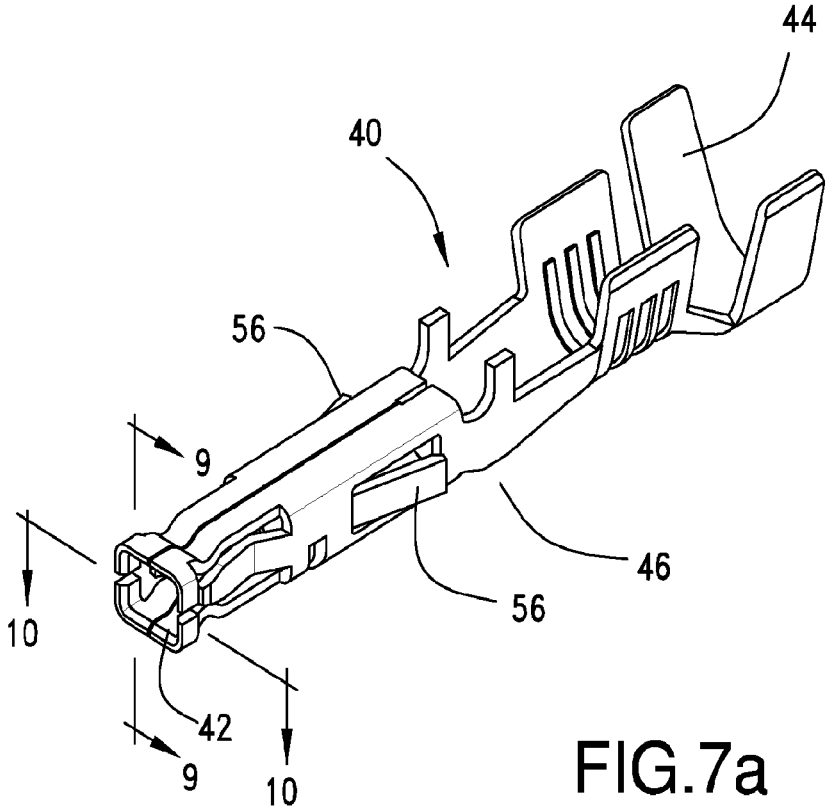
FIG. 7*a* is a perspective view of the female terminal looking at the top of the terminal.
Figure 7B:
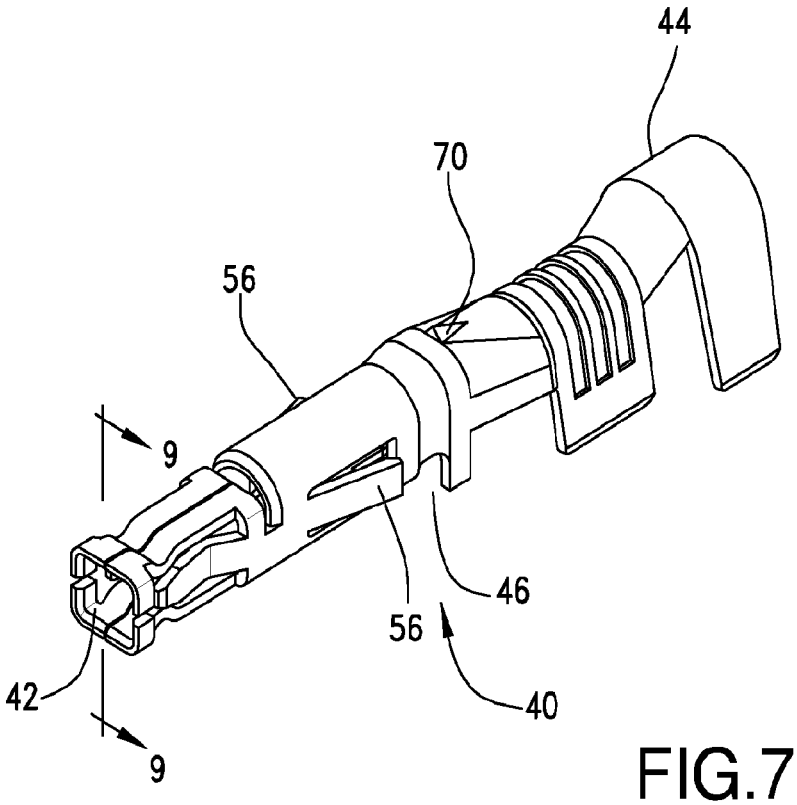
FIG. 7*b* is a perspective view similar to FIG. 7*a* looking at the bottom of the terminal.

As shown in FIG. 6, the U-shaped channels 51 and 52 form a first pair of opposing sidewalls 57 and 59 and channel sidewalls 80, 81 and 82, 83 formed on the respective U-shaped channels 51 and 52 form a second pair of opposing sidewalls adjacent the first pair of sidewalls 57 and 59 generally creating a square or rectangular shaped passageway 43 in the female terminal 40. Sidewalls 57 and 59 have primary contacts 60 and 62 respectively formed therein and channel sidewalls 80, 81 and 82, 83 have arc discharging contacts 85 and 86 respectively formed therein. Arc discharging contacts 85 and 86 formed on the channel sidewalls 80, 81 and 82, 83 are positioned closer to the mating end 42 of the female terminal 40 than the primary contacts 60 and 62 formed on the sidewalls 57 and 59 of the U-shaped channels 51 and 52.

Also as shown in FIG. 6 the opposing sidewalls 57 and 59 form two of the passageway sidewalls. The remaining adjacent two sidewalls of the square or rectangular shaped passageway 43 are formed by each pair of opposing channel sidewalls 80, 81 and 82, 83. In this case, there are four portions that make up these opposing adjacent sidewalls 80, 81 and 82, 83. Each of these portions has arc discharging contacts 85 and 86 formed therein. As best shown in FIG. 6 the arc discharging contacts 85 and 86 are formed in the same relative position on the channel sidewalls 80, 81 and 82, 83 but may be in a staggered relationship but in any event all are positioned forward of the primary contacts 60 and 62.

FIGS. 9-15, sequentially illustrate the insertion of the male terminal 25, which in this embodiment is in the form of a generally rectangular pin, into the mating portion 42 of the female terminal 40.

Figure 11:
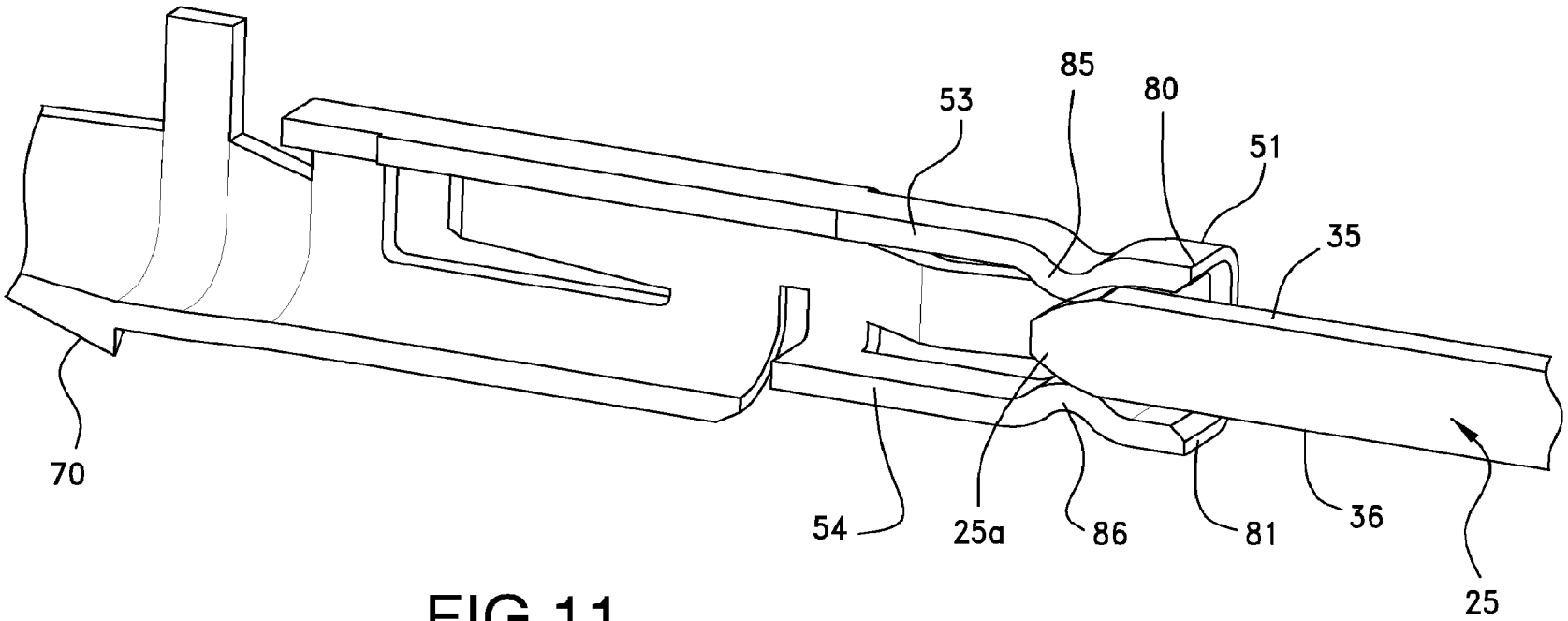
FIG.11 is a sectional view of the female terminal similar to FIG. 9 with the male pin partially inserted.
Figure 12:
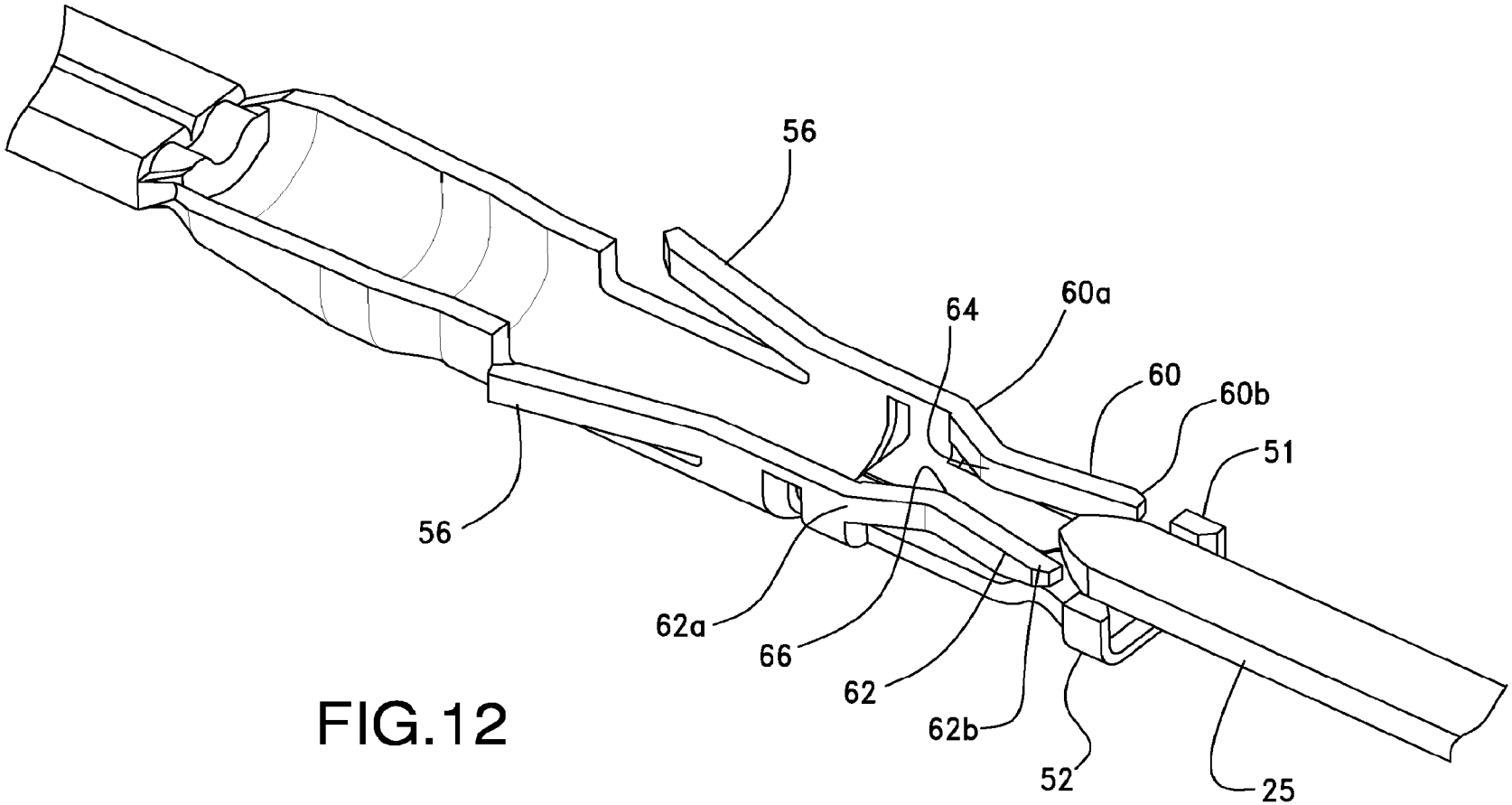
FIG. 12 is a sectional view of the female terminal similar to FIG. 9 with the male pin partially inserted.

FIGS. 9 and 10 illustrate the condition in which no male terminal 25 is in the passageway 43. FIGS. 11 and 12 illustrate the condition in which male terminal 25 is beginning to be inserted into the passageway 43. The tapered end 25*a* of terminal 25 just contacts the arc discharging contacts 85 and 86. Each arc discharging contact 85 and 86 formed on the opposing channel sidewalls 80, 81 and 82, 83 may contact the male pin 25 at four different individual points to compensate for any misalignment between the male pin 25 and female terminal 40. At this time, if there is a voltage potential between the male pins 25 and the female terminals 40, as may be the case with hot pluggable connectors, an arc discharge may occur between male terminal 25 and one or all of the arc discharging contacts 85 and 86 formed on the opposing channel sidewalls 80, 81 and 82, 83.

Figure 13:
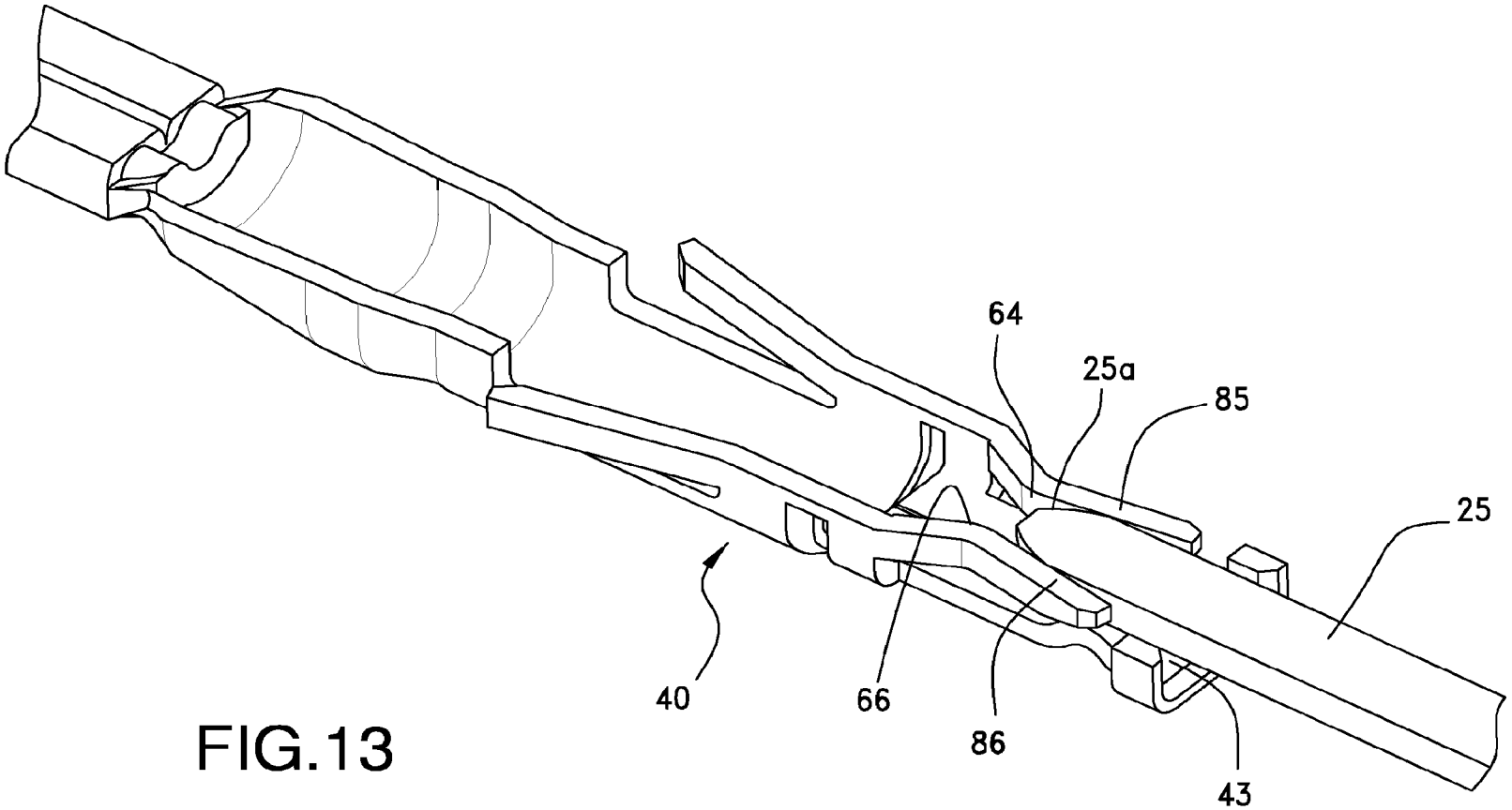
FIG. 13 is a sectional view of the female terminal similar to FIG. 12 with the male pin further inserted.

FIG. 13 illustrates the condition in which the male terminal 25 is further inserted into the passageway 43, such that sidewalls of male terminal 25 now engage the arc discharging contacts 85 and 86. The deflection portions 90 and 92 of the opposed channel sidewalls 81 and 82 which define the passageway 43 are resilient and permit the wedge shaped end 25*a* of the male pin 25 to flex the channel sidewalls 81 and 82 apart as the male pin 25 engages the arc discharging contacts 85 and 86.

Upon further insertion of the male pin 25 the wedge shaped end 25*a* contacts the contact portions 64 and 66 of primary contacts 60 and 62. At this time, both the male pin 25 and female terminal 40 are at the same voltage potential eliminating arcing between the male pin 25 and female terminal 40 and therefore no buildup of non-conducting residue, providing positive electrical connecting therebetween.

Figure 14:
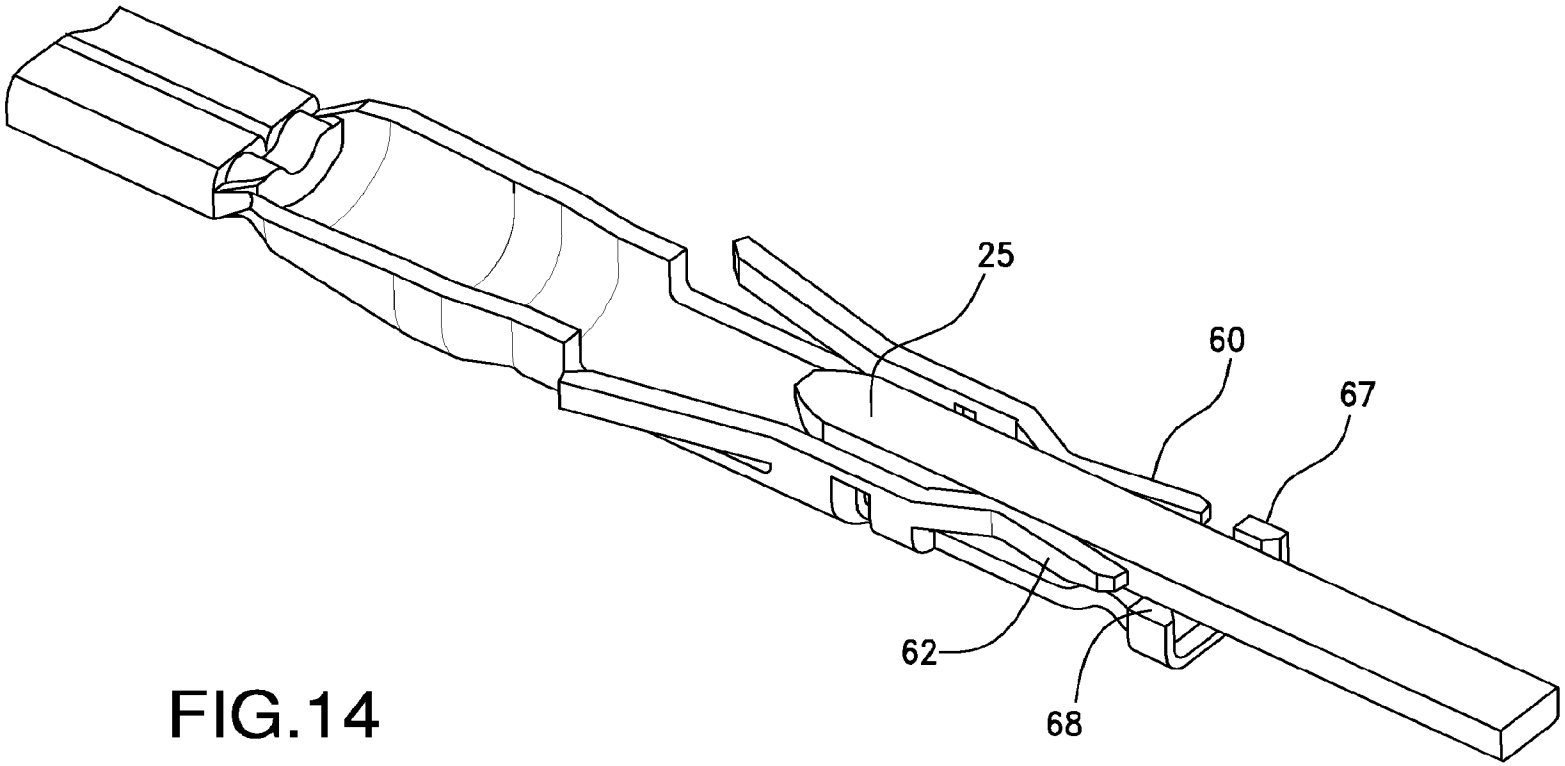
FIG. 14 is a sectional view of the female terminal similar to FIG. 13 with the male pin fully inserted.
Figure 15:
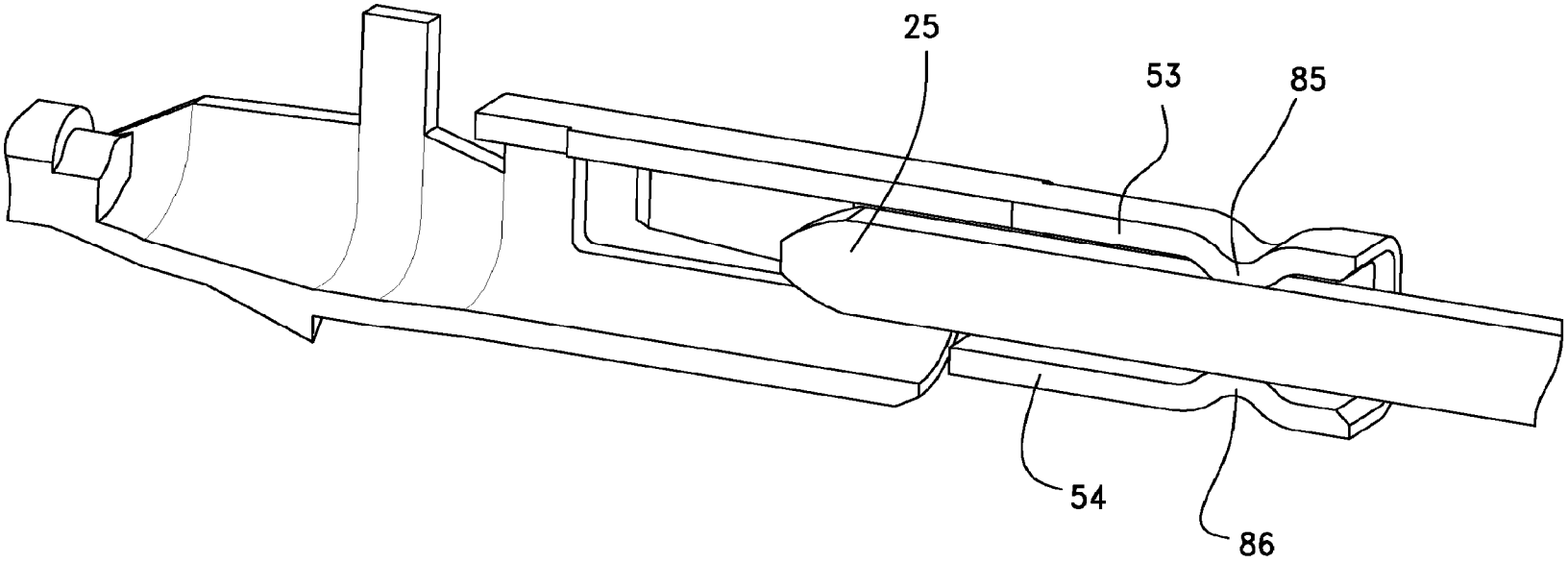
FIG. 15 is a sectional view of the female terminal similar to FIG. 11 with the male pin fully inserted.

FIGS. 14 and 15 illustrate the complete insertion of male pin 25 into passageway 43. The arc discharging contacts 85 and 86 are formed closer to passageway 43 of the mating portion 42 of the female terminal 40 than the primary contacts 60 and 62. The primary contacts 60 and 62 are positioned behind the arc discharging contacts 85 and 86 so that upon insertion of the male pin 25, electrical contact is first made between the male pin 25 and the arc discharging contacts 85 and 86. The resiliency of deflection portions 90 and 92 of the opposed channel sidewalls 81 and 82 holds and biases the arc discharging contacts 85 and 86 against the male pin 25 by applying normal forces thereto and maintain electrical contact between the male pin 25 and female terminal 40 while not imparting any separation forces between the male pin 25 and the primary contacts 60 and 62. Upon further insertion, the male pin 25 subsequently engages the primary contacts 60 and 62 while still engaging the arc discharging contacts 85 and 86. This ensures that an improved electrical contact will exist between the male pin 25 and the primary contacts 60 and 62 of the female terminal 40.

Typically, the prior art disclose the primary contacts positioned at the base of the beam member and the arc discharging contacts are positioned further from the base of the beam member. The closer to the base of a beam that beam deflection occurs the greater the reaction force. Since the arc discharging contact are on the same beam member and positioned further away from the base, the primary contacts essentially lift the arc discharging contact off of the male pin therefore minimizing the electrical force between the arc discharging contacts and the male pin. The further from the base of the beam member that the deflections occurs the lesser the reaction force.

Similarly, in this case, the arc discharging contacts 85 and 86 engage the male pin 25 first and subsequently the primary contacts 60 and 62. Primary contacts 60 and 62 and arc discharging contacts 85 and 86 are not formed on the same beam member but on adjacent members or sidewalls and the resulting reaction force act on different planes. In this case the reaction forces are normal to each other and therefore are independent of each other. In other words, the reaction forces of the primary contacts 60 and 62 do not lift the arc discharging contacts 85 and 86 off of the male pin 25.

It is to be understood that such terms as "top", "bottom", "front", "back" or the like, as used herein and in the claims hereof, are used as relative terms only in order to provide a more clear and concise understanding of the invention. Such terms are not to be construed as limiting, because the terminals of the present invention may be oriented in many different directions in actual use, as is well known to persons skilled in the art.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

The invention claimed is:

1. A female terminal, comprising:

a terminal body with a mating end and a circuit connecting end, the mating end being formed of a pair of channels that are generally U-shaped in cross-section, the pair of channels defining a passageway therebetween for receiving a male terminal therein, each channel having a bottom sidewall and two opposed channel sidewalls extending from the bottom sidewall, each bottom sidewall having a slit to define first and second deflection portions of the bottom sidewall;

a primary contact disposed along one of the bottom sidewalls and configured to engage, in operation, a flat surface of the male terminal when the male terminal is inserted into the passageway; and an arc discharging contact disposed along one of the channel sidewalls forward of the primary contact, the arc discharging contact extending inwardly, such that the male terminal, in operation, comes into contact with the arc discharging contact before coming into contact with the primary contact as the male terminal is inserted into the passageway, whereby any arc discharge between the male and female terminals occurs at the arc discharging contact.

2. The female terminal of claim 1, wherein the primary contact is formed on each bottom sidewall.

3. The female terminal of claim 1, wherein the arc discharging contact is formed on each channel sidewall.

4. The female terminal of claim 1, wherein the terminal body has an intermediate portion between the mating end and the circuit connecting end, the intermediate portion having a projection extending outwardly therefrom.

5. The female terminal of claim 4, wherein the projection is configured, in operation, to come into contact with shoulders formed in a housing upon the insertion of the female terminal into the housing.

6. A connector, comprising:

a female terminal as defined in claim 1; and an insulative housing generally surrounding at least a portion of the female terminal.

7. The female terminal of claim 1, wherein the pair of channels are separated by slits, whereby ends of the pair of channels are spaced adjacently to, but apart from, each other.

8. The female terminal of claim 1, wherein the primary contact is positioned rearward of the first and second deflection portions.

9. The female terminal of claim 1, wherein the arc discharging contact is positioned rearward of the first and second deflection portions.

10. The female terminal of claim 1, wherein the arc discharging contact has a circular cross-section that is curved inwardly into the passageway.

11. The female terminal of claim 1, wherein the primary contact is in the form of a cantilevered beam that extends forwardly from one of the bottom sidewalls toward the corresponding first and second deflection portions.

12. The female terminal of claim 11, wherein the primary contact extends into the passageway to provide a contact area which is contacted by the male terminal when the male terminal is inserted into the passageway.

13. A female terminal, comprising:

a terminal body with a mating end and a circuit connecting end, the mating end being formed of a pair of channels that are generally U-shaped in cross-section, the pair of channels defining a passageway therebetween for receiving a male terminal therein, each channel having a bottom sidewall and two opposed channel sidewalls extending from the bottom sidewall;

a primary contact disposed along one of the bottom sidewalls and configured to engage, in operation, a flat surface of the male terminal when the male terminal is inserted into the passageway, the primary contact being in the form of a cantilevered beam that extends forwardly from one of the bottom sidewalls toward a position where the male terminal is received within the passageway, the primary contact extending into the passageway to provide a contact area which is contacted by the male terminal when the male terminal is inserted into the passageway; and an arc discharging contact disposed along one of the channel sidewalls forward of the primary contact, the arc discharging contact extending inwardly, such that the male terminal, in operation, comes into contact with the arc discharging contact before coming into contact with the primary contact as the male terminal is inserted into the passageway, whereby any arc discharge between the male and female terminals occurs at the arc discharging contact.

14. The female terminal of claim 13, wherein the primary contact is formed on each bottom sidewall.

15. The female terminal of claim 13, wherein the arc discharging contact is formed on each channel sidewall.

16. The female terminal of claim 13, wherein the pair of channels are separated by slits, whereby ends of the pair of channels are spaced adjacently to, but apart from, each other.

17. The female terminal of claim 13, wherein each bottom sidewall has a slit to define first and second deflection portions of the bottom sidewall, the arc discharging contact being positioned rearward of the first and second deflection portions.

18. The female terminal of claim 13, wherein the arc discharging contact has a circular cross-section that is curved inwardly into the passageway.

19. A connector, comprising:

a female terminal as defined in claim 13; and an insulative housing generally surrounding at least a portion of the female terminal.

20. A female terminal, comprising:

a terminal body with a mating end and a circuit connecting end, the mating end being formed of a pair of channels that are generally U-shaped in cross-section, the pair of channels defining a passageway therebetween for receiving a male terminal therein, each channel having a bottom sidewall and two opposed channel sidewalls extending from the bottom sidewall, the pair of channels being separated by slits, whereby ends of the pair of channels are spaced adjacently to, but apart from, each other;

a primary contact disposed along one of the bottom sidewalls and configured to engage, in operation, a flat surface of the male terminal when the male terminal is inserted into the passageway; and an arc discharging contact disposed along each of the four channel sidewalls forward of the primary contact, each arc discharging contact extending inwardly, such that the male terminal, in operation, comes into contact with at least one of the four arc discharging contacts before coming into contact with the primary contact as the male terminal is inserted into the passageway, whereby any arc discharge between the male and female terminals occurs at the at least one of four arc discharging contacts.

* * * * *